US005409564A

United States Patent [19]

Aaldijk

[11] Patent Number: 5,409,564

[45] Date of Patent: Apr. 25, 1995

[54] FLEXIBLE CRACK SPREAD PREVENTING, SEPARABLE WEB-TYPE JOINING MATERIAL FOR JOINING A BEARING FACE OF A STRUCTURE TO A COVERING LAYER TO BE PROVIDED THEREON, METHOD FOR USE OF AND COVERING LAYER CONSTRUCTION FORMED WITH THIS MATERIAL

[76] Inventor: Cornelius Aaldijk, Regentesselaan 15, 3762 DS Soest, Netherlands

[21] Appl. No.: 77,139

[22] Filed: Jun. 15, 1993

Related U.S. Application Data

[63] Continuation-in-part of Ser. No. 818,245, Dec. 30, 1991, abandoned, which is a continuation of Ser. No. 604,792, Oct. 29, 1990, abandoned.

[30] Foreign Application Priority Data

Nov. 14, 1989 [NL] Netherlands ..... 8902815

[51] Int. Cl.[6] ..... E04F 13/00; E04F 15/00; E02D 37/00

[52] U.S. Cl. ..... 156/71; 52/514; 156/148; 428/234; 428/300

[58] Field of Search ..... 428/300, 301, 302, 234, 428/235, 251, 284, 285; 28/107; 52/514, 746; 156/94, 71, 148

[56] References Cited

U.S. PATENT DOCUMENTS

| | | | |
|---|---|---|---|
| 3,953,974 | 5/1976 | Bresson | 428/300 |
| 4,153,750 | 5/1979 | Piguilloud | 428/300 |
| 4,230,762 | 10/1980 | Iwasaki | 428/234 |
| 4,368,844 | 1/1983 | Miller | 428/300 |
| 4,522,876 | 6/1985 | Hiers | 428/300 |
| 4,976,290 | 12/1990 | Gelin | 428/300 |

FOREIGN PATENT DOCUMENTS

| | | | |
|---|---|---|---|
| 0679995 | 2/1964 | Canada | 428/300 |
| 2630769 | 11/1989 | France | 52/514 |
| 0290453 | 5/1991 | Germany | 52/514 |
| 2-153156 | 6/1990 | Japan | 52/514 |
| 5-125841 | 5/1993 | Japan | 52/514 |

*Primary Examiner*—Michael W. Ball
*Assistant Examiner*—Daniel J. Stemmer
*Attorney, Agent, or Firm*—Beehler & Pavitt

[57] ABSTRACT

A rigid covering is joined to a concrete floor by a composite having a upper and lower nonwoven layers separated by a thin plastic film and interconnected by fiber bridges extending through holes in the film and formed by needle punching through the upper layer and the film. The lower layer is bonded to the floor with epoxy resin and a rigid covering is applied to the upper layer also with epoxy resin. The plastic film is non-adhering to the epoxy and the fiber bridges break in the vicinity of a crack in the concrete surface to locally delaminate the upper and lower layers of the composite and thus prevent transmission of the crack through the composite. The lower layer can be formed as a byproduct of the needle punching operation resulting in a thin adhesive conserving lower layer.

17 Claims, 2 Drawing Sheets

FLEXIBLE CRACK SPREAD PREVENTING, SEPARABLE WEB-TYPE JOINING MATERIAL FOR JOINING A BEARING FACE OF A STRUCTURE TO A COVERING LAYER TO BE PROVIDED THEREON, METHOD FOR USE OF AND COVERING LAYER CONSTRUCTION FORMED WITH THIS MATERIAL

This is a continuation in part application of U.S. application Ser. No. 07/818,245, filed Dec. 30, 1991, now abandoned, which is a continuation of U.S. application Ser. No. 07/604,792, now abandoned, filed Oct. 29, 1990.

BACKGROUND OF THE INVENTION

1. Field of the Invention

The present invention relates to the use of a flexible crack spread preventing, separable web-type joining material in a method for joining a bearing face of a structure to a rigid covering layer to be provided thereon.

2. Description of the Prior Art

Due to thermal and mechanical movements in buildings and constructions, small cracks can develop in concrete structures with a size normally ranging from 0.1–0.5 mm. Under extreme conditions these cracks can have a width of even several mm.

Consequently, in building structures where a rigid covering layer, such as an ornamental layer of tile surface, is provided on a bearing face of a building, pool, stock container or bridge, there is a risk that on the occurrence of these cracks in said bearing face of, for example, concrete the covering layer will also crack.

As a result of these cracks considerable damage can be created due to among others;

- leakage of (rain) water via the crack into a concrete construction causing corrosion in the armouring steel wire or in a steel bridge construction.
- leakage of water or e.g. chemical waste out of a stock container into the soil.

The European legislation at this moment requires for this reason that floors of warehouses, walls and floors of storage tanks etc. are protected against leakage. The German "Wasserhaushalts Gesetz" requires for such areas a crackbridging lining that is able to cover cracks of at least 0.2 mm.

At this moment various techniques are used to fullfill these requirements.

1. A thick lining made from highly flexible polymers such as flexibilised polyesters or polyurethanes. In general, the elongation at break for such products is over 100%. Due to the high flexibility, the mechanical and chemical properties of such linings are limited.

Such products have in general also a high plastic deformation next to the elastic deformation.

If a crack is formed underneath such linings the material, adjacent to the crack, will flow towards the crack and thus the crack remains covered. The crack bridging properties depend on the thickness of the lining and its flexibility which is strongly influenced by the temperature.

2. To overcome the limited mechanical and/or chemical properties of such linings, they can be covered by a nonwoven or woven reinforcement and protected by a covering layer with better mechanical and/or chemical properties. Such sandwich constructions combine the flexibility of the lower covering layer with the rigid properties of the top layer. Such constructions can generally cover cracks up till approximately 0.5 mm.

The problem is that they are very elaborative and difficult to apply—in particular on vertical surfaces.

The mechanical properties are limited since the brittle toplining can be pressed through the soft lower lining.

3. The third possibility is to make a rigid, e.g. glass reinforced lining like a tank in a tank. This lining is self supporting. In case of a crack in the substrate, the adhesion between the substrate and the lining is lost. Due to the selfsupporting character of the lining this is no problem as long as the delamination is limited. However due to frequent thermal expansions and contractions the delamination tends to grow and the lining can be completely loose its outer support. Besides, such linings are usually thick and expensive.

4. In order to eliminate the problems, it is also known to make use of, for example, elastified resin systems combined with a fibrous web.

When the bearing face cracks the elastified resin must then be capable of bridging the crack, but the crack-bridging action here depends on the quality which happens to exist in the adhesion to the bearing face. With good adhesion the crack-bridging action will generally be limited to less than 1 mm, depending on the thickness of the elastic covering layer and on the temperature. Only if the adhesion is poor good crack bridging can be obtained, since the fibrous web above the crack can only stretch with it if it is not adhering to the underlying bearing face.

Through the use of, for example, elastified polyester resins in these systems, one is, however, tied to a particular type of resin which limits the potential uses through its specific mechanical and chemical properties. There is also the problem that, due to high shrinkage, approximately 5%, and low alkali resistance, they can cause adhesion problems, as a result of which the covering can come away completely from the bearing face and loses its mechanical strength.

Such a known fixing of a bearing face with a rigid covering layer also produces many problems when one wishes to remove a fitted covering layer, since the known fixing is difficult to break.

Summarizing, in order to avoid damage to buildings and other constructions but also as a result of the increasing environmental concern, there is a growing interest in the use of protective and decorative lining systems with crackspread preventing properties.

SUMMARY OF THE INVENTION

The object of the present invention is now to provide a method for applying a rigid covering to a bearing face by means of an adhesive and accommodating therebetween a web-type joining material which prevents cracks which occur in a bearing face of, for example, concrete, masonry or wood, such as a roof, floor or wall of a building structure, such as a building, bridge or pool, from spreading into a rigid covering layer provided thereon and joined thereto by means of an adhesive, while in addition a covering layer once fitted can be removed more or less easily.

This object is achieved according to the invention through the fact that the joining material comprises at least a nonwoven lower fixing layer separated by a thin, flexible, nonporous essentially non-adhering separating nonfoamed foil layer, from an upper stretchable fixing nonwoven layer, while on either side of the separating layer and extending through it breakable bridges join together the lower and upper fixing layer and the breaking strength between the lower fixing layer and the upper fixing layer, which is in the form of a nonwoven layer, is controlled by the number of breakable bridges between these layers. The bridges extending on either side of the separating layer are expediently formed by needle punching from the upper to the lower fixing layer through the separating layer. In this way, a covering layer once fitted can easily be removed with the use of a small number of breakable bridges, while this is much more difficult with a large number of bridges. Basically the invention provides a method to create a well defined adhesion between two layers impregnated with binder since there is a direct relationship between the number of bridges and the adhesion between the impregnated upper and lower fixing layer A nonporous and non-adhering separating foil layer in this case is understood to mean a layer which does not adhere to the adhesive agents used for bonding the lower fixing layer to the bearing face and the upper fixing layer to the covering layer. Preferably the separating layer is a thermoplastic foil layer, particularly made from polyethylene, polypropylene, teflon and the like.

A nonfoamed foil is required in order to allow escape of air entrapped between the binder applied on a bearing face and the lower fixing layer during applying said joining layer. Such air must escape through the holes in the foil for passing the fiber bridges.

In case of a foamed foil there is a risk that the foam seals the holes completely and moreover the compression strength of the foil material is questionable in the method of the invention.

Air must be allowed to escape in order to avoid accumulation of moisture in the air inclusions and to secure the compression strength.

Besides a foam layer may be impregnated with the binder resin resulting into additional adhesion between the upper and lower fixing layers.

In view of these problems a nonwoven structure with an intermediate foam layer as disclosed in Canadian specification 679995 can not be used in the method of the present invention.

With the use of the flexible crack spread preventing, web-type joining material in the method according to the invention it is possible to join a bearing face well to a rigid covering layer through the fact that the lower fixing layer, preferably a nonwoven layer, is bonded with a synthetic resin to the bearing face, while at the other side the covering layer, for example a covering layer made from synthetic resin and filler particles, is formed in and on the upper fixing layer, and crack formation in the bearing face still does not spread into the covering layer.

More particularly, the controlled amount of breakable fiber bridges allow a well controlled delamination being created in case of a crack in the bearing face resulting in basically unlimited crack bridging properties e.g. of 10 mm. and more without the need of using highly flexible resins.

When cracks occur in, for example, bearing faces made of concrete, as a result of which the lower nonwoven layer cracks, shearing stresses occur in the breakable bridges joining the lower fibrous web layer to the upper fixing layer which at the same time leads to a tensile stress in the upper fixing nonwoven layer.

If now the shear strength of the fibers near the crack is higher than the tensile strength of the upper layer over the crack then the upper layer will break. This is comparable to the normal situation where a lining adheres well to the substrate.

If however, the shear strength of the fiber bridges near the crack is smaller than the tensile strength of the upper layer over the crack, the number of bridges will give way under the influence of the shearing stress, so that a local delamination takes place. Consequently, the then free part of the upper fixing layer can stretch over the delaminated area and can thus absorb the crack width in the bearing face. The extent of delamination can be controlled by a suitable control of the number of breakable bridges, the tensile strength of the upper fixing layer, and the elasticity thereof.

In the case of a small number of breakable fiber bridges, delamination will easily be obtained, which is particularly desirable with the use of the joining material according to the invention for strippable floor or wall systems.

With a larger number of fiber bridges, the mechanical strength of the system will, however, increase considerably.

Moreover, due to the simple application of the web of the abovementioned joining material the costs for this system are very low in comparison to most other systems used for crack bridging properties.

The filler particles as used in the rigid covering layer can be, for example, powder particles, such as quartz powder particles, or granular particles or granulate particles, such as gravel particles.

The thickness of the lower nonwoven layer is expediently as low as possible, in order to reduce the consumption of resin for the bonding of this lower nonwoven layer to the bearing face.

In a very preferred emodiment the lower nonwoven only comprises fibers of the upper nonwoven layer which fibers have been pushed through the non-adhering separating foil layer so that one might say that the lower nonwoven layer has been formed in situ.

The upper fixing layer can also contain woven or nonwoven glass fibers as a result of which special requirements for mechanical properties of the covering layer can be met, e.g. that a greater tensile strength is obtained, and in particular a higher modulus, so that the covering layer itself is subjected to less stress or conductive fibers in order to meet certain electro conductive requirements.

In general, a synthetic resin is selected for bonding the lower nonwoven layer to the bearing face and the upper fixing layer to the rigid covering layer, and this resin can be selected freely depending on the further use requirements.

Essential is that the separating foil layer between the upper and lower nonwoven layer does not adhere to the bonding agents as applied on the upper and lower nonwoven layers.

Suitable bonding agents are unsaturated polyester resins, polyurethanes, polymethyl methacrylates or epoxy resins, or formulations based on such resins. Also bituminous resins and cementitious plasters or mortars modified with dispersed synthetic resins which can be used for glueing ceramic tiles can be used.

The invention also relates to a covering layer construction on a bearing face of a structure with a rigid covering layer provided thereon and a web-type separable joining material placed between them, said joining material comprising at least a lower fixing layer separated by a thin, nonporous, flexible, essentially non-adhering separating foil layer, from a stretchable upper fixing layer, while on either side of the separating layer and extending through it breakable bridges join together the lower and upper fixing layers, and lower and upper fixing layer are joined to the bearing face or the covering layer.

Such a covering layer construction is particularly suitable for providing, for example, a covering layer of filler particles bound by synthetic resin as a protective and/or decorative layer on floors, roofs and walls of a building.

DESCRIPTION OF THE PREFERRED EMBODIMENT

Figure 1:
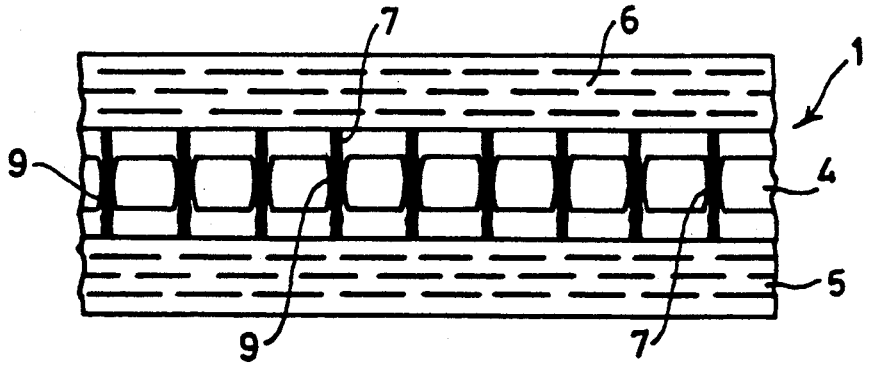
FIG. 1 shows a cross-section of a web-type joining material according to the invention.

FIG. 1 shows a flexible crack spread preventing, separable web-type joining material 1, comprising a lower fixing layer, in the form of a polyester nonwoven layer 5, and a upper fixing polyester nonwoven layer 6, separated from each other by a thin, flexible, non-porous separating layer 4, in the form of a nonfoamed polythylene plastic film. This thermoplastic film does not adhere to thermosetting resins.

In the present case the upper fixing layer 6 is a nonwoven of plastic fibres.

Through needle punching breakable fiber bridges 7 are formed between lower nonwoven layer 5 and upper nonwoven fixing layer 6, which fiber bridges 7 extend through holes 9 in the plastic film.

It is expedient to work with 5 to 80 needle punches per $cm^2$ for forming the breakable fiber bridges. Typically the number of bridges ranges from 30 to 60 per $cm^2$.

With the use of 10 needle punches per $cm^2$ a readily usable product is obtained, but the ventilation of the lower nonwoven 5 can then sometimes be difficult during the impregnation with certain synthetic resins.

With the use of 30–60 needle punches per $cm^2$ a very good ventilation of the lower nonwoven layer 5 is obtained during the bonding to a bearing face 2. However, the adhesion strength between the different layers 5 and 6 increases greatly in that case.

The nonwoven layer 5 is expediently made of thermoplastic fibers weighing about 50 $g/m^2$ or less, while the nonwoven layer 6 weighs about 50–500 $g/m^2$ or more and is typically a few mm.

The nonwoven layer 6 is expediently approximately 2 mm thick, while the thickness of nonwoven layer 5 is selected as low as possible. These values are, however, given only by way of illustration.

The separating foil layer is typically a polyethylene or polypropylene foil of 100 $g/m^2$.

Figure 2:
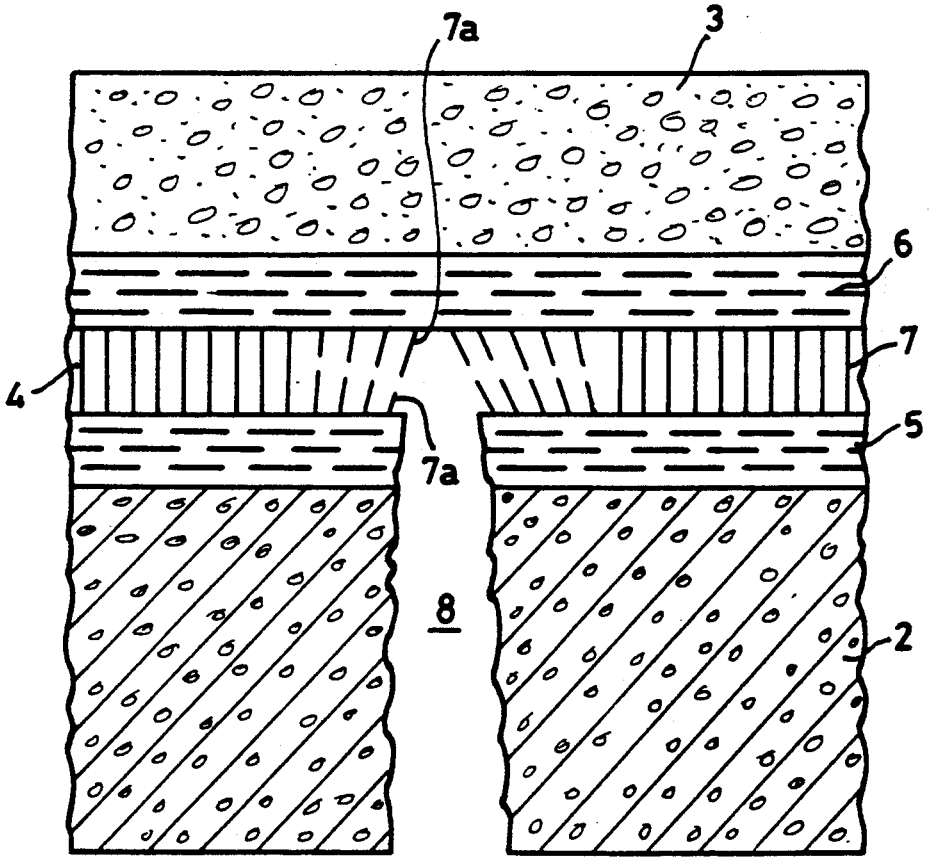
FIG. 2 shows a covering layer construction on a floor of a building and a rigid protective covering layer of filler particles, such as quartz powder, bonded together by epoxy resin provided thereon.

FIG. 2 shows what effects occur with crack formation in a floor 2 of a building on which the joining material 1 is fixed by means of a synthetic binder resin (epoxy resin) which has penetrated into the lower nonwoven layer 5 and fiber bridges 7. At the other side, a covering layer 3 of filler particles such as quartz powder particles bound by epoxy resin is formed on and into the upper fixing nonwoven layer 6.

The number of needle punches forming fiber bridges in the joining material was 30/$cm^2$.

When a crack 8 forms in the concrete floor 2, the lower nonwoven layer 5, fully connected with the floor 2, will also crack with the result that fiber bridges **7*a* in the vicinity of the crack 8** which has occurred are also broken.

Through the breaking of the fiber bridges **7*a*, the upper stretchable fixing layer 6 has come away from the lower nonwoven layer 5 through delamination and can itself stretch in order to prevent the crack 8 which has formed from spreading into the rigid covering layer 3**.

If one wishes to be able to remove the covering layer 3 of filler particles bonded by epoxy resin easily after a period of time, use can be made of a joining material with fiber bridges formed by 5–10, preferably 10, needle punches per $cm^2$.

After impregnation of the fiber bridges with the binder resin and curing of same the bridges will provide an adhesion between the upper and lower fixing layer, also having been impregnated with the binder resin and said binder having been cured comprised between 0.2 and 10 $N/mm^2$ using 5 to 80 fiber bridges per $cm^2$. Preferably the adhesion strength is 0.5 to 3 $N/mm^2$ using 30 to 60 bridges per $cm^2$ depending on the size of the used needle.

Figure 3:
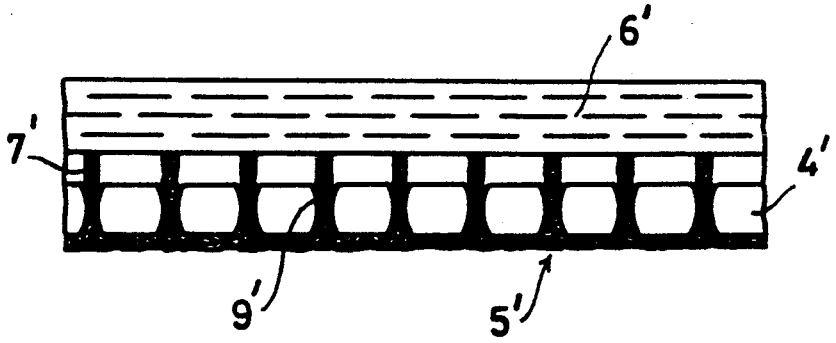
FIG. 3 shows a cross section of a preferred web-type joining material for use in a construction as shown in FIG. 2.

FIG. 3 shows a cross section of a preferred web type joining material for use in the method of the invention.

The joining material comprises an upper nonwoven layer 6' of polyester, an intermediate polyethylene foil layer 4' and in situ formed lower nonwoven layer 5'. The nonwoven layer 5' has been obtained by placing a polyester nonwoven layer upon a polyethylene foil and subjecting said combination to needle punching from the side of layer 6'. The needles will punch 30 to 60 holes 9' per $cm^2$ in the foil 4' and simultaneously fibers from nonwoven layer 6' will be pushed through these holes 9' thereby forming the nonwoven lower layer 5' and breakable fiber bridges 7'.

A substantial amount of liquid resin can be saved by using this joining material as the in situ formed nonwoven layer 5' will be very thin e.g. 0.2 mm.

The nonwoven layers may be formed from organic fibers, such as fibers of thermoplastics such as polyester, nylon, aramide and also from inorganic fibers such as carbon and the like.

The abovementioned joining materials can be used in buildings, bridges on ships, on walls, floors or ceilings etc. As bearing substrate one can use concrete, bricks, wood or steel or any other construction material.

The following examples illustrate the invention without limiting the scope of the invention.

MANUFACTURING WEB-TYPE JOINING MATERIAL

EXAMPLE I

A nonporous and nonfoamed polyethylene film of 100 $g/m^2$ is covered at its upper side with an upper layer of polyester nonwoven of 165 $g/m^2$ LUTRADUR A1F of Freudenberg and at its lower side with a polyester nonwoven lower layer of 50 $g/m^2$.

This sandwich structure is subjected to needle punching from the upper side with 40 needle punches/$cm^2$ and provides a web-type joining material with a thin lower nonwoven layer to be joined to a bearing face and a much thicker upper nonwoven layer to be joined to a rigid covering layer.

In this example needles of gauge 38, having a triangular blade height of 0.53 mm have been used. Depending on the desired adhesion needles of another gauge type may be used. E.g. a needle of gauge 13 has a blade height of 2.45 mm and gauge 46 has a blade height of 0.33 mm.

A thicker needle will give a thicker fiber bridge and higher adhesion whereas a thinner needle will give a thinner fiber bridge and a lower adhesion.

EXAMPLE II

The procedure of Example I is repeated but the amount 30 of needle punches amounts to 10, 20 and 80 resp.

EXAMPLE III

The procedure of Example I is repeated with a polypropylene and teflon foil resp. instead of a polyethylene foil.

EXAMPLE IV

The procedure of Examples I and II is repeated with a polyester or Teflon foil instead of a polyethylene foil.

This joining material should be applied if hot bitumen is used as a binder.

EXAMPLE V

The procedure of Example I is repeated with an upper nonwoven polyester layer of 80 g/m$^2$ or 200 g/m$^2$.

EXAMPLE VI

A nonporous and nonfoamed polyethylene foil of 100 g/m$^2$ is covered at its upper side with an upper layer of polyester non woven of 165 g/m$^2$ and the sandwich structure of two layers is subjected to needle punching with 40 needle punches per cm$^2$.

The web-type joining material as obtained comprises an upper nonwoven layer to be fixed to a rigid covering layer and an in situ formed lower non woven layer to be fixed to a bearing face such as a concrete floor.

METHOD OF JOINING A CONCRETE FLOOR WITH A RIGID COVERING LAYER.

EXAMPLE VII

A concrete floor having a cohesion of 3N/mm$^2$ is coated with 250–500 g/m$^2$ of an epoxy primer.

The joining material according to Example I is rolled in the wet primer with the lower side of the joining material directed to the primer surface.

The lower nonwoven layer and the fiber bridges extending through the polyethylene foil are fully impregnated with the primer.

Entrapped air can escape through the holes in the foil.

Subsequently on and in the still dry nonwoven upper layer an epoxy resin formulation is applied e.g. 2 to 3 kg/m$^2$.

After curing an additional layer of an epoxy resin formulation can be applied. It is also possible to sprinkle the upper side with sand or to seal same with other materials e.g.

The covering layer will not crack if in the concrete floor cracks of 5 mm width are formed.

Due to the presence of the fiber bridges, which have been impregnated with the binder resin, these bridges provide after curing of the binder resin, an adhesion between the lower and upper fixing layer (also being impregnated with binder resin which has been cured) of 1.8N/mm$^2$.

With the same number of bridges but using coarser or finer needles this will result in a higher or lower adhesion.

Similar results are obtained by using joining materials according to Examples II–V.

EXAMPLE VIII

A concrete floor is coated according to Example VII with 100 to 200 g/m$^2$ of an epoxy primer and a joining material of Example VI.

The same results are obtained as in Example VII, however a considerable lower amount of epoxy primer was used. The rigid covering layer could also be removed very easily if same should be renovated.

What is claimed is:

1. The method for applying a rigid covering layer to a bearing face of a supporting structure, comprising the steps of:

providing a composite having a lower nonwoven layer and an upper nonwoven layer separated by a thin film separating layer, said upper and lower nonwoven layers being joined by fiber bridges formed by fibers of the nonwoven layers extending through holes in said thin film; and bonding said lower nonwoven layer to said bearing face and bonding said rigid covering layer to said upper nonwoven layer by means of an adhesive;

said thin film separating layer being non-foamed, non-porous and non-adhering to said adhesive, said fiber bridges being selected and arranged such that in the event of cracking of said bearing face the fiber bridges break in the vicinity of the crack and allow local separation of the upper and lower nonwoven layers thereby to avoid transmission of the crack from the lower to the upper layer and to the rigid covering layer.

2. The method of claim 1, wherein the fiber bridges have been formed by needle punching.

3. The method of claim 1, wherein the fiber bridges have been formed by needle punching from the upper nonwoven layer.

4. The method of claim 1, wherein the nonwoven layer is formed by subjecting a combination of said thin film and said upper nonwoven layer to needle punching from the upper nonwoven layer.

5. The method of claim 1, wherein the separating layer is a foil of thermoplastic material.

6. The method of claim 1, wherein the nonwoven layers comprise fibers selected from the group consisting of organic and inorganic fibers.

7. The method of claim 1, wherein the nonwoven layers comprise fibers selected from the group consisting of polyester, nylon, glass, carbon and aramide materials.

8. The method of claim 1, wherein the upper nonwoven layer has a weight between 50 and 500 g/m$^2$.

9. The method of claim 1, wherein the number of fiber bridges ranges from 5 to 80 and provide an adhesion of between 0.2 and 10 N/mm$^2$ between the upper and lower nonwoven layer after impregnation with said adhesive and after curing of said adhesive.

10. The method of claim 1, wherein the lower nonwoven layer has a weight of at most 50 g/m$^2$.

11. The method of claim 1, wherein the adhesive for adhesively bonding said upper and said lower nonwoven layers is selected from the group consisting of unsaturated polyester resins, polyurethanes, polymethyl metacrylates, epoxy resins, bituminous resins, cementitious plasters, and mortars.

12. The method of claim 1, wherein said thin film is selected from the group consisting of polyethylene, polypropylene, polyester and teflon.

13. The method of claim 1, wherein the nonwoven layers comprise fibers of thermoplastic material.

14. The method of claim 1, wherein the upper nonwoven layer has a weight between 80 and 200 g/m$^2$.

15. The method of claim 9, wherein said adhesion is between 0.5 and 3 N/mm$^2$.

16. The method of claim 1, wherein said step of bonding said lower nonwoven layer further comprises the step of impregnating said lower nonwoven layer including said fiber bridges with said adhesive.

17. The method of claim 16 wherein said step of bonding said upper nonwoven layer to said rigid covering further comprises the step of impregnating said upper nonwoven layer with said adhesive.

* * * * *